US010446082B2

(12) United States Patent
Hao et al.

(10) Patent No.: US 10,446,082 B2
(45) Date of Patent: Oct. 15, 2019

(54) OLED PIXEL CIRCUIT AND DRIVING METHOD FOR IMPROVING LIGHT EMITTING EFFICIENCY

(71) Applicant: BOE TECHNOLOGY GROUP CO., LTD., Beijing (CN)

(72) Inventors: Xueguang Hao, Beijing (CN); Hongfei Cheng, Beijing (CN); Zhanjie Ma, Beijing (CN); Yong Qiao, Beijing (CN); Xinyin Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 13 days.

(21) Appl. No.: 15/328,736

(22) PCT Filed: Jul. 5, 2016

(86) PCT No.: PCT/CN2016/088534
§ 371 (c)(1),
(2) Date: Jan. 24, 2017

(87) PCT Pub. No.: WO2017/128624
PCT Pub. Date: Aug. 3, 2017

(65) Prior Publication Data

US 2018/0053469 A1 Feb. 22, 2018
US 2018/0301089 A9 Oct. 18, 2018

(30) Foreign Application Priority Data

Jan. 26, 2016 (CN) ..... 2016 1 0051753

(51) Int. Cl.
*G09G 3/3233* (2016.01)
*G09G 3/3258* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC ..... G09G 3/30; G09G 3/32; G09G 3/3208; G09G 3/3216; G09G 3/3225;
(Continued)

(56) References Cited

U.S. PATENT DOCUMENTS 8,330,679 B2 * 12/2012 Miyazawa ..... G09G 3/3241 315/169.3
10,255,859 B2 * 4/2019 Wang ..... G09G 3/3258
(Continued)

FOREIGN PATENT DOCUMENTS

CN 1388952 A 1/2003
CN 1584963 A 2/2005
(Continued)

OTHER PUBLICATIONS

China First Office Action, Application No. 201610051753.4, dated Aug. 28, 2017, 12 pps. with English translation.
(Continued)

*Primary Examiner* — Amit Chatly
*Assistant Examiner* — Nelson Lam
(74) *Attorney, Agent, or Firm* — Armstrong Teasdale LLP

(57) ABSTRACT

The disclosure provides a pixel circuit including a reset module, a data write module, a storage module, a compensation and hold module, a drive module, and a light emitting device. The reset module is connected to the storage module and the light emitting device. The data write module is connected to the drive module. The compensation and hold module is connected to the drive module and the storage module. The storage module is connected to the drive module. The drive module is connected to the light emitting device.

14 Claims, 2 Drawing Sheets

(52) U.S. Cl.
CPC ..... *G09G 2300/0819* (2013.01); *G09G 2300/0842* (2013.01); *G09G 2300/0866* (2013.01); *G09G 2310/0264* (2013.01)

(58) Field of Classification Search
CPC .... G09G 3/3233; G09G 3/3241; G09G 3/325; G09G 3/3258; G09G 3/3283; G09G 3/3291
USPC ..... 345/76–83; 315/169.3
See application file for complete search history.

(56) References Cited

U.S. PATENT DOCUMENTS

| | | | | |
|---|---|---|---|---|
| 2006/0244688 | A1 | 11/2006 | Ahn et al. | |
| 2006/0244695 | A1 | 11/2006 | Komiya | |
| 2007/0152934 | A1 | 7/2007 | Maeda | |
| 2009/0201278 | A1 | 8/2009 | Kane | |
| 2011/0115835 | A1 | 5/2011 | Lee | |
| 2014/0139502 | A1* | 5/2014 | Han | G09G 3/3233 345/212 |
| 2015/0221255 | A1* | 8/2015 | Qing | G06F 3/0412 345/173 |
| 2016/0055797 | A1* | 2/2016 | Tan | G09G 3/3258 345/206 |
| 2016/0125808 | A1* | 5/2016 | Hsu | G09G 3/3233 345/212 |
| 2016/0358546 | A1* | 12/2016 | Ma | G09G 3/32 |
| 2016/0372030 | A1* | 12/2016 | Nagayama | G09G 3/32 |
| 2017/0047007 | A1* | 2/2017 | Yin | G09G 3/3233 |
| 2018/0190185 | A1* | 7/2018 | Ko | G09G 3/325 |
| 2018/0240400 | A1* | 8/2018 | Zhou | G09G 3/325 |
| 2018/0315374 | A1* | 11/2018 | Zhang | G09G 3/3208 |
| 2019/0005877 | A1* | 1/2019 | Dong | G09G 3/3208 |

FOREIGN PATENT DOCUMENTS

| | | | |
|---|---|---|---|
| CN | 1855198 | A | 11/2006 |
| CN | 1864189 | A | 11/2006 |
| CN | 101548311 | A | 9/2009 |
| CN | 101996582 | A | 3/2011 |
| CN | 102063861 | A | 5/2011 |
| CN | 104732919 | A | 6/2015 |
| CN | 105654906 | A | 6/2016 |
| KR | 20020025876 | A | 4/2002 |
| WO | 0175852 | A1 | 10/2001 |
| WO | 2005069260 | A2 | 7/2005 |

OTHER PUBLICATIONS

China Second Office Action, Application No. 201610051753.4, dated Jan. 17, 2018, 19 pps. with English translation.
PCT (CN) International Search Report, Application No. PCT/CN2016/088534, dated Sep. 29, 2016, 6 pps.
PCT (CN) Written Opinion, Application No. PCT/CN2016/088534, dated Sep. 29, 2016, 8 pps. with English Translation.
European Extended Search Report, Application No. 16826278.0, dated Jul. 15, 2019, 9 pps.

* cited by examiner

OLED PIXEL CIRCUIT AND DRIVING METHOD FOR IMPROVING LIGHT EMITTING EFFICIENCY

This application is a National Stage entry of PCT/CN2016/088534 filed Jul. 5, 2016, which claims the benefit and priority of Chinese Patent Application No. 201610051753.4, filed on Jan. 26, 2016, both of which are incorporated by reference herein in their entirety as part of the present application.

BACKGROUND

The present disclosure relates to the field of display technology, and particularly, to a pixel circuit and a driving method thereof, a display panel, and a display device.

Currently a typical quantum dot light emitting diode (QLED) structure includes an electron transport layer, a hole transport layer, and a quantum dot light emitting layer. The hole transport layer and the electron transport layer may include organic small molecules, organic polymer, or inorganic metal oxides. The arrangement of the hole transport layer and the electron transport layer enables the light emitting efficiency of the quantum dot light emitting diode to rise from the initial less than 0.1% to about 10%, but the mismatch of the highest occupied molecular orbital (HOMO) energy levels between the hole transport layer and the quantum dot light emitting layer cause the quantum dots charge injection efficiency to remain low. Further, the quantum dots charge injection is unbalanced and the quantum dots represent non-electric-neutral. Compared with conventional organic electroluminescent light emitting diodes (OLEDs), the drawback of charge injection imbalance of quantum dot electroluminescent light emitting diodes (QLEDs) limits their light emitting lifetime and efficiency.

In the prior art, the problem is mainly improved in the following three ways. The first way is to increase the HOMO energy level of the hole transport layer to match the HOMO energy level of the quantum dot light emitting material as closely as possible. The second way is to increase the mobility rate and injection efficiency of holes by providing a hole enhancing layer. The third way is to slow down the injection rate of electrons by providing an electronic barrier layer, improving the recombination efficiency of electrons and holes. With regards to the first way, it is difficult to synthesize or find a material necessary for constituting the hole transport layer. With regards to the second way, it is necessary to provide a multilayer hole transport layer, which increases the difficulty of the process. With regards to the third way, excited photons cannot be increased. Thus, it is difficult to improve the light emitting efficiency.

BRIEF DESCRIPTION

Embodiments of the present disclosure provide a pixel circuit, a driving method thereof, a display panel, and a display device for improving the light emitting efficiency of a light emitting device.

According to a first aspect, the present disclosure provides a pixel circuit including a reset module, a data write module, a storage module, a compensation and hold module, a drive module, and a light emitting device. The reset module is connected to the storage module and the light emitting device. The data write module is connected to the drive module. The compensation and hold module is connected to the drive module and the storage module. The storage module is connected to the drive module and is configured to store the control voltage. The drive module is connected to the light emitting device.

In some embodiments of the present disclosure, the reset module is configured to reset the storage module and the light emitting device. The data write module is configured to provide a data current. The compensation and hold module is configured to generate a control voltage for the drive module, wherein the control voltage is a function of data current. Also, the compensation and hold module is further configured to hold the control voltage. The storage module is configured to store the control voltage. The drive module is configured to generate a drive current according to the control voltage. The light emitting device is configured to emit light under the drive current.

In some embodiments of the present disclosure, the compensation and hold module includes a third transistor, wherein a control electrode of the third transistor is connected to a second voltage line, wherein a first electrode of the third transistor is connected to a first voltage line, and wherein a second electrode of the third transistor is connected to the drive module and the storage module.

In some embodiments of the present disclosure, the reset module includes a fourth transistor, wherein a control electrode of the fourth transistor is connected to the second voltage line, wherein a first electrode of the fourth transistor is connected to the storage module and the light emitting device, and wherein a second electrode of the fourth transistor is connected to a third voltage line.

In some embodiments of the present disclosure, the drive module includes a second transistor, wherein a first electrode of the second transistor is connected to the first voltage line, and wherein the storage module is connected between the control electrode and the second electrode of the second transistor.

In some embodiments of the present disclosure, the data write module includes a first transistor, wherein a control electrode of the first transistor is connected to the second voltage line, wherein a first electrode of the first transistor is connected to the drive module, and wherein a second electrode of the first transistor is connected to a data current line.

In some embodiments of the present disclosure, the storage module includes a capacitor, and the drive module is connected between the first and second ends of the capacitor.

In some embodiments of the present disclosure, the transistors are N-type MOS transistors.

In some embodiments of the present disclosure, the transistors are P-type MOS transistors.

According to a second aspect, the present disclosure provides a method for driving the above-described pixel circuit, including a first stage and a second stage. In the first stage, a data current is provided by the data write module, and the drive module, the data write module, the compensation and hold module, and the reset module are turned on, such that the compensation and hold module generates the control voltage, and such that the storage module stores the control voltage, which is a function of data current. In the second stage, the drive module is turned on, and the data write module, the compensation and hold module, and the reset module are turned off, such that the drive module generates the drive current according to the control voltage stored in the storage module, and such that the light emitting device emits light under the drive current.

According to a third aspect, the present disclosure provides a display panel including the above-described pixel circuit.

According to a fourth aspect, the present disclosure provides a display device including the above-described display panel.

The pixel circuit and the driving method thereof, the display panel, and the display device according to the embodiments of the present disclosure enable the drive module to provide a drive current equal to a data current when driving the light emitting device, increasing the driving current without increasing the power consumption of the light emitting device. The increase of the drive current increases the charge injected into the light emitting device, improves the light emitting efficiency, and overcomes the drawback in the conventional voltage compensation circuit that it is necessary to increase the power consumption of the light emitting device in order to increase the drive current flowing into the light emitting diode.

BRIEF DESCRIPTION OF THE DRAWINGS

In order to more clearly illustrate the technical solution in the embodiments of the present disclosure, the drawings in the embodiments will be briefly described below. It should be understood that the drawings described below relate only to some embodiments of the present disclosure, instead of limiting the present disclosure, in which.

DETAILED DESCRIPTION

In order that the technical solutions and advantages of the embodiments of the present disclosure will become more apparent, the technical solutions of the embodiments of the present disclosure will be clearly and completely described below with reference to the accompanying drawings. Obviously, the described embodiments are a part of the embodiments of the present disclosure, but not all embodiments. Based on the described embodiments of the present disclosure, all other embodiments obtained by those skilled in the art without the need for creative work fall within the scope of the present disclosure.

Figure 1:
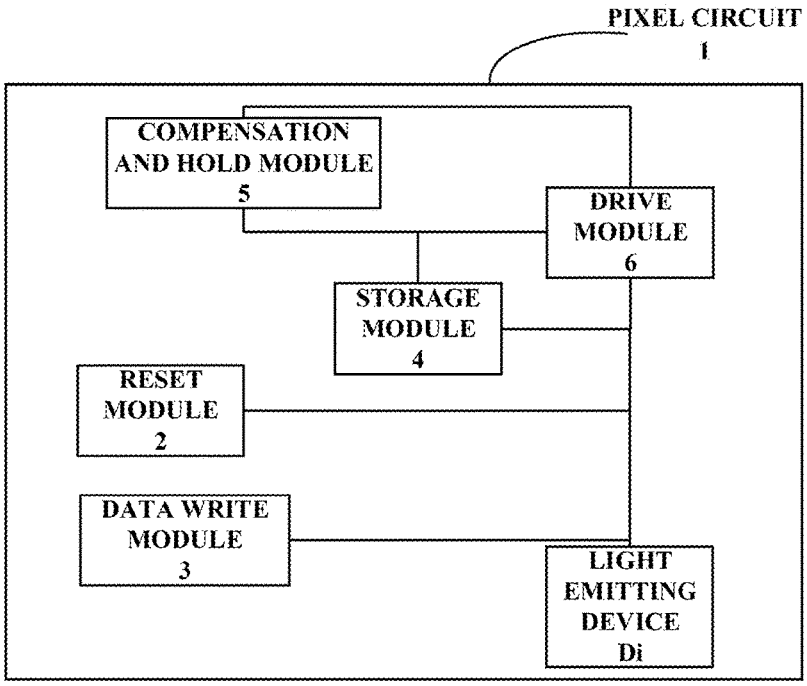
FIG. 1 is a block diagram of a pixel circuit 1 according to a first embodiment of the present disclosure.

FIG. 1 is a block diagram of a pixel circuit 1 according to a first embodiment of the present disclosure. As shown in FIG. 1, the pixel circuit 1 includes a reset module 2, a data write module 3, a storage module 4, a compensation and hold module 5, a drive module 6, and a light emitting device Di. The reset module 2 is connected to the storage module 4 and the light emitting device Di. The data write module 3 is connected to the drive module 6. The compensation and hold module 5 is connected to the drive module 6 and the storage module 4. The storage module 4 is connected to the drive module 6. The drive module 6 is connected to the light emitting device Di.

The reset module 2 is configured to reset the storage module 4 and the light emitting device Di. The data write module 3 is configured to provide a data current. The compensation and hold module 5 is configured to generate a control voltage for the drive module, wherein the control voltage is a function of data current. The compensation and hold module 5 is further configured to hold the control voltage. The storage module 4 is configured to store the control voltage. The drive module 6 is configured to generate a drive current according to the control voltage. The light emitting device Di is configured to emit light under the drive current.

Figure 2:
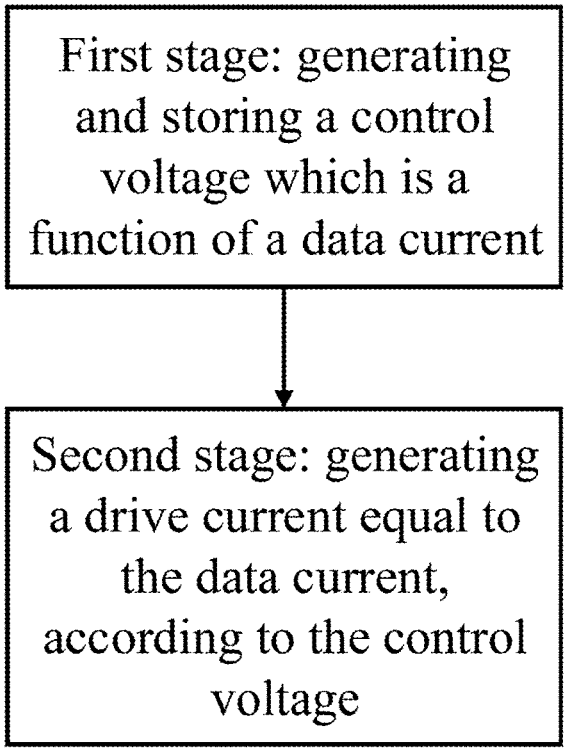
FIG. 2 is a diagram illustrating a method for driving the pixel circuit 1 according to a second embodiment of the present disclosure.

FIG. 2 is a diagram illustrating a method for driving the pixel circuit 1 according to a second embodiment of the present disclosure. As shown in FIG. 2, the second embodiment of the present disclosure provides a method for driving the above pixel circuit 1, including a first stage and a second stage. In the first stage, a data current is provided by the data write module 3. The drive module 6, the data write module 3, the compensation and hold module 5, and the reset module 2 are turned on, such that the compensation and hold module 5 generates the control voltage, and the storage module 4 stores the control voltage, which is a function of data current. In the second stage, the drive module 6 is turned on, and the data write module 3, the compensation and hold module 5, and the reset module 2 are turned off, such that the drive module 6 generates the drive current according to the control voltage stored in the storage module 4, and the light emitting device Di emits light under the drive current.

According to an embodiment of the present disclosure, there is provided a pixel circuit 1 capable of current compensation driving. In the pixel circuit 1, when a data current is written to the pixel circuit 1 by the data write module 3, the storage module 4 stores the control voltage. The control voltage is related to the data current under the action of the compensation and hold module 5, and may cause the drive module 6 to generate a drive current equal to the data current. Therefore, the drive module 6 can provide a drive current equal to the data current when driving the light emitting device Di, based on the voltage stored in the storage module 4. According to the embodiment of the present disclosure, the drive current is increased without increasing the power consumption of the light emitting device Di, wherein the light emitting efficiency is improved, thereby the drawback in the conventional voltage compensation circuit that it is necessary to increase the power consumption of the light emitting device Di in order to increase the drive current flowing into the light emitting diode is overcame.

Figure 3:
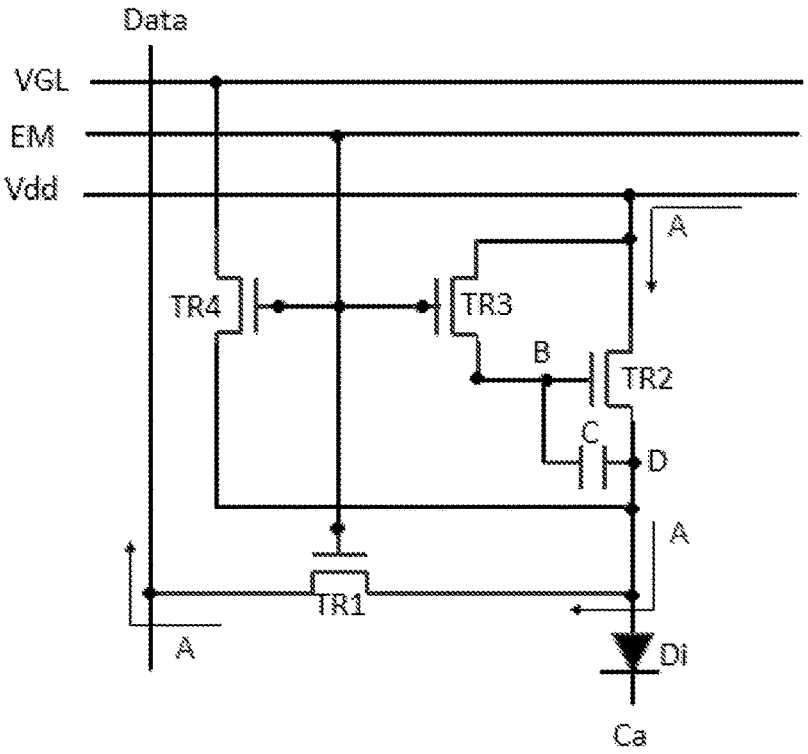
FIG. 3 is a schematic circuit diagram of the pixel circuit 1 of the embodiment shown in FIG. 1.

FIG. 3 is a schematic circuit diagram of the pixel circuit 1 of the embodiment shown in FIG. 1. As shown in FIG. 3, the data write module 3 includes a first transistor, a control electrode of the first transistor is connected to the second voltage line, a first electrode of the first transistor is connected to the drive module 6, and a second electrode of the first transistor is connected to a data current line. The drive module 6 includes a second transistor, a first electrode of the second transistor is connected to the first voltage line, and the storage module 4 is connected between the control electrode and the second electrode of the second transistor. The compensation and hold module 5 includes a third transistor, a control electrode of the third transistor is connected to the second voltage line, a first electrode of the third transistor is connected to the first voltage line, and a second electrode of the third transistor is connected to the drive module 6. The reset module 2 includes a fourth transistor, a control electrode of the fourth transistor is connected to the second voltage line, a first electrode of the fourth transistor is connected to the storage module 4 and the drive module 6, and a second electrode of the fourth transistor is connected to a third voltage line. The storage module 4 includes a capacitor, and the drive module 6 is connected between the first and second ends of the capacitor.

Specifically, the first electrode of the first transistor TR1 is connected to the second electrode of the second transistor TR2, the second electrode of the first transistor TR1 is connected to the data current line Data, and the control electrode of the first transistor TR1 is connected to the second voltage line EM. The first electrode of the second transistor TR2 is connected to the first voltage line Vdd, and the capacitor C is connected between the control electrode and the second electrode of the second transistor TR2. The control electrode of the third transistor TR3 is connected to the second voltage line EM, the first electrode of the third transistor TR3 is connected to the first voltage line Vdd, and the second electrode of the third transistor TR3 is connected to the control electrode of the second transistor TR2. The control electrode of the fourth transistor TR4 is connected to the second voltage line EM, the first electrode of the fourth transistor TR4 is connected to the third voltage line VGL, and the second electrode of the fourth transistor TR4 is connected to the second electrode of the second transistor TR2. The capacitor C is connected between the control electrode and the second electrode of the second transistor TR2. The anode of the light emitting device Di is connected to the second electrode of the second transistor TR2, and the cathode of the light emitting device Di is connected to the fourth voltage terminal Ca.

The transistors may be N-type MOS transistors and may also be P-type MOS transistors. When different types of transistors are used, the circuit structures are the same, and the control voltages applied to turn on the transistors are different. Hereinafter, the operation of the pixel circuit 1 shown in FIG. 2 will be described taking the N-type MOS transistor as an example.

Figure 4:
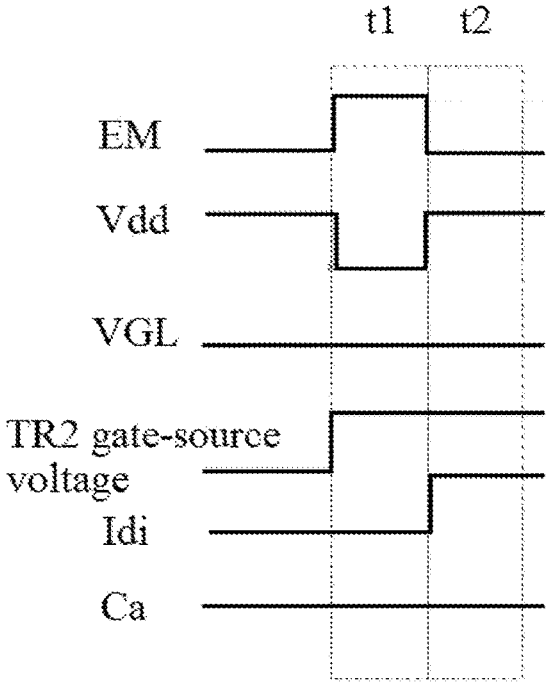
FIG. 4 is a signal timing chart of the pixel circuit 1 shown in FIG. 3.

FIG. 4 is a signal timing chart of the pixel circuit 1 shown in FIG. 3. As shown in FIG. 4, the operation of the pixel circuit 1 includes a first stage and a second stage.

In the first stage t1, a high-level voltage V2 is applied to the second voltage line EM, the high-level voltage turns on the transistors TR1, TR3, and TR4, connected to the second voltage line EM. A low level voltage VL is applied to the first voltage line Vdd, a low level voltage Vcom is applied to the cathode of the light emitting device Di, VL<Vcom, wherein no current flows through the light emitting device Di, and the light emitting device Di is turned off without emitting light. A traction current is applied to the data current line Data. Since the first transistor TR1 is turned on, and the third transistor TR3 is turned on so that the second transistor TR2 forms a diode connection, the current A flowing through the second transistor TR2 is controlled by the traction current flowing through the data current line Data, and is equal to the traction current, wherein the current A flows in the direction of the arrow shown in the figure. Since the gate-source voltage of the second transistor TR2 has a fixed function relationship with the current flowing through the drain and the source, the gate-source voltage of the second transistor TR2 changes to Vgs associated with the current A and is also controlled by the traction current. The capacitor C is gradually charged, and finally stores the voltage Vgs across two ends of the capacitor C. In addition, the internal capacitor between the source and the drain of the third transistor TR3 stores the voltage Vgd of the gate and the drain of the second transistor TR2 at this time.

In addition, a low level voltage V3 is applied to the third voltage line VGL, and since the fourth transistor TR4 is turned on, the second electrode of the second transistor TR2, the second end of the capacitor C, and the anode of the light emitting device Di are reset to the voltage V3, and the low level voltage V3 serves to eliminate the influence of the residual charge in the capacitor C and the second transistor TR2 on the current A, and can more reliably turn off the light emitting device Di.

In the second stage t2, a low level voltage V2' is applied to the second voltage line EM, wherein this low level voltage turns off the transistors TR1, TR3, and TR4. At this time, a high-level voltage VH (VH>Vcom) is applied to the first voltage line Vdd, the light emitting device Di is turned on, and a current flows through the light emitting device Di to emit light. Since the voltage on the capacitor C does not change, the voltage between the gate and the source of the second transistor TR2 is the same as the voltage Vgs in the first stage t1. When the third transistor TR3 is turned off, due to the action of its internal capacitor, it has a holding effect on the gate and drain voltage Vgd of the second transistor TR2. Thus, the drive current flowing through the second transistor TR2 is equal to the current A flowing through the second transistor TR2 in the first stage t1.

According to an embodiment of the present disclosure, by adjusting the value of the traction current on the data current line Data in the first stage t1, the drive current flowing into the light emitting diode in the second stage t2 can be changed, thereby making the light emitting device Di have the optimum light emitting efficiency. Therefore, the light emitting efficiency of the pixel circuit 1 can be improved without changing the structure of the light emitting device Di. This effect is more apparent to the quantum dot electroluminescent light emitting device. In the case of the quantum dot electroluminescent light emitting device, the use of the pixel circuit 1 increases the current injected into the light emitting device Di, and increases the hole injection rate and injection efficiency, thereby increasing the recombination probability of holes and electrons, and improving the light emitting efficiency of the light emitting device Di. The pixel circuit 1 overcomes the drawback that the power consumption of the device will be increased as long as the drive circuit is added in the conventional voltage compensation circuit.

According to a third embodiment of the present disclosure, there is provided a display panel including the pixel circuit 1 described above.

According to a fourth embodiment of the present disclosure, there is provided a display device including the above-described display panel. The display device may be any product or component having a display function, such as an electronic paper, a mobile phone, a tablet computer, a television set, a display, a notebook computer, a digital photo frame, and/or a navigator.

It should be noted that, in the above description, the high-level and the low level represent only a function that the voltage can realize, without specific limitation on the voltage value. For example, the high-level voltage V2 applied to the second voltage line EM may be any voltage that can turn on the transistors TR1, TR3, and TR4, and the low level voltage V2' may be any voltage that can turn off the transistors TR1, TR3, and TR4. The low level voltages VL, V3, and Vcom applied to the first voltage line Vdd, the third voltage line VGL, and the cathode of the light emitting diodes Di, respectively, may be any voltage that can turn off the light emitting diodes Di, while the current A can follow in the direction shown in FIG. 2. The high-level voltage VH applied to the first voltage line Vdd and the low level voltage Vcom applied to the cathode of the light emitting device Di may be any voltage that can turn on the light emitting device Di.

In addition, when the transistors are P-type MOS transistors, the voltage for turning on the transistors changes, simply, in the first stage t1, and a low level voltage V2 applied to the second voltage line EM turns on the transistors TR1, TR3, and TR4. In the second stage t2, a high-level voltage V2' applied to the second voltage line EM turns off the transistors TR1, TR3, and TR4.

In addition, the first electrode of the transistor refers to one of the source and the drain, and the second electrode refers to the other of the source and the drain. For each transistor, the first and second electrodes can be determined individually. That is, the first electrodes of different transistors may be the same or different. Likewise, the second electrodes may be the same or different. Therefore, the description using the first and second electrodes is used merely to more conveniently illustrate the principles of the present disclosure, and is not to be construed as limiting the present disclosure.

It is to be understood that the above embodiments are exemplary embodiments employed for the purpose of illustrating the principles of the present disclosure, but the disclosure is not limited thereto. It will be apparent to those skilled in the art that various modifications and improvements can be made without departing from the spirit and essence of the disclosure, and are considered to be within the scope of the disclosure.

What is claimed is:

1. A pixel circuit comprising:

a reset module;

a data write module;

a storage module;

a compensation and hold module;

a drive module; and a light emitting device, wherein the reset module is connected to the storage module and the light emitting device, wherein the data write module is connected to the drive module, wherein the compensation and hold module is connected to the drive module and the storage module, wherein the storage module is connected to the drive module, and wherein the drive module is connected to the light emitting device;

wherein the reset module is configured to reset the storage module and the light emitting device, wherein the data write module is configured to provide a data current, wherein the compensation and hold module is configured to generate a control voltage for the drive module, wherein the control voltage is a function of data current, wherein the compensation and hold module is further configured to hold the control voltage, wherein the storage module is configured to store the control voltage, wherein the drive module is configured to generate a drive current according to the control voltage, and wherein the light emitting device is configured to emit light under the drive current;

wherein the data write module comprises a first transistor, wherein a control electrode of the first transistor is connected to a second voltage line, wherein a first electrode of the first transistor is directly connected to the drive module and the light emitting device, and wherein a second electrode of the first transistor is connected to a data current line; and wherein the compensation and hold module comprises a third transistor, wherein a control electrode of the third transistor is connected to the second voltage line, wherein a first electrode of the third transistor is connected to a first voltage line, and wherein a second electrode of the third transistor is connected to the drive module and the storage module.

2. The pixel circuit according to claim 1, wherein the reset module comprises a fourth transistor, wherein a control electrode of the fourth transistor is connected to the second voltage line, wherein a first electrode of the fourth transistor is connected to the storage module and the light emitting device, and wherein a second electrode of the fourth transistor is connected to a third voltage line.

3. The pixel circuit according to claim 1, wherein the drive module comprises a second transistor, wherein a first electrode of the second transistor is connected to the first voltage line, and wherein the storage module is connected between a control electrode and a second electrode of the second transistor.

4. The pixel circuit according to claim 1, wherein the storage module comprises a capacitor, and wherein the drive module is connected between first and second ends of the capacitor.

5. The pixel circuit according to claim 1, wherein the third transistor is an N-type MOS transistor.

6. The pixel circuit according to claim 1, wherein the third transistor is a P-type MOS transistor.

7. A method for driving the pixel circuit according to claim 1, the method comprising:

a first stage including i) providing a data current by the data write module, and ii) turning on the drive module, the data write module, the compensation and hold module, and the reset module, wherein the compensation and hold module generates the control voltage and the storage module stores the control voltage, and wherein the control voltage is a function of data current; and a second stage including i) turning on the drive module, and ii) laming off the data write module, the compensation and hold module, and the reset module, wherein the drive module generates a drive current according to the control voltage stored in the storage module, and wherein the light emitting device emits light under the drive current.

8. A display panel comprising the pixel circuit according to claim 1.

9. A display device comprising the display panel according to claim 8.

10. The display panel according to claim 8, wherein the reset module comprises a fourth transistor, wherein a control electrode of the fourth transistor is connected to the second voltage line, wherein a first electrode of the fourth transistor is connected to the storage module and the light emitting device, and wherein a second electrode of the fourth transistor is connected to a third voltage line.

11. The display panel according to claim 8, wherein the drive module comprises a second transistor, wherein a first electrode of the second transistor is connected to the first voltage line, and wherein the storage module is connected between a control electrode and a second electrode of the second transistor.

12. The display panel according to claim 8, wherein the storage module comprises a capacitor, and wherein the drive module is connected between first and second ends of the capacitor.

13. The display panel according to claim 8, wherein the third transistor is an N-type MOS transistor.

14. The display panel according to claim 8, wherein the third transistor is a P-type MOS transistor.

* * * * *